US005740647A

United States Patent [19]

Kelly

[11] Patent Number: 5,740,647

[45] Date of Patent: Apr. 21, 1998

[54] BULIT-UP ROOF (BUR) OR MODIFIED ROOF ASSEMBLY SYSTEM

[76] Inventor: Thomas L. Kelly, 31 Sands St., Waterbury, Conn. 06710

[21] Appl. No.: 460,404

[22] Filed: Jun. 1, 1995

[51] Int. Cl.[6] ..... E04B 7/00

[52] U.S. Cl. ..... 52/408; 52/410; 52/199; 52/94

[58] Field of Search ..... 52/94, 408, 410, 52/58, 199

[56] References Cited

U.S. PATENT DOCUMENTS

| | | | |
|---|---|---|---|
| 2,857,861 | 10/1958 | Trostle | 52/94 |
| 3,668,811 | 6/1972 | Pollard | 52/94 |
| 3,735,540 | 5/1973 | Thaler | 52/94 |
| 3,971,184 | 7/1976 | Van Wagoner | 52/408 X |
| 4,162,597 | 7/1979 | Kelly | 52/410 |
| 4,223,486 | 9/1980 | Kelly | 52/1 |
| 4,489,531 | 12/1984 | Nelson | 52/408 X |
| 4,492,064 | 1/1985 | Bynoe | 52/408 X |
| 4,557,081 | 12/1985 | Kelly | 52/94 |
| 4,719,723 | 1/1988 | Van Wagoner | 52/408 X |
| 4,736,561 | 4/1988 | Lehr et al. | 52/410 |
| 4,888,930 | 12/1989 | Kelly | 52/410 |
| 4,937,990 | 7/1990 | Paquette | 52/408 X |
| 5,319,900 | 6/1994 | Lehuert et al. | 52/408 |

FOREIGN PATENT DOCUMENTS

| | | | |
|---|---|---|---|
| 2149957 | 4/1973 | Germany | 52/94 |

*Primary Examiner*—Carl D. Friedman
*Assistant Examiner*—Winnie S. Yip
*Attorney, Agent, or Firm*—Fishman, Dionne, Cantor & Colburn

[57] ABSTRACT

Roofing system is presented comprising a built-up roof (BUR) assembly or modified roof membrane assembly (MRM) which is adhered to gypsum, concrete or composite sheets or panels which have been loose-laid over a roof substrate. This allows the BUR or MRM assemblies to conduct heat to or receive heat from the thermal mass of the loose laid mass-weighted sheets immediately below the BUR or MRM assemblies. The gypsum panels, preformed concrete panels, poured-in-place concrete or composite mass-weighted construction panels which are placed between the BUR or MRM assemblies and the roof substrate causes more gradual changes in temperature between the roof assembly and the roof substrate. Because the BUR or MRM assemblies, which are attached to the loose laid gypsum or the like panels, can move independently of the insulated roof substrate panels with the expansion and contraction concomitant thermal cycling, wrinkles and tears previously associated with the joint lines of the roof substrate panels are practically eliminated. Additionally, the weighted roof assembly of the invention aids in wind uplift protection by providing a floating, moveable mass under the BUR or MRM assemblies by distributing wind uplift shock away from the perimeter edge of the roof and into the interior thereof.

39 Claims, 3 Drawing Sheets

BULIT-UP ROOF (BUR) OR MODIFIED ROOF ASSEMBLY SYSTEM

BACKGROUND OF THE INVENTORY

This invention relates generally to roofing systems for buildings. More particularly, this invention relates to built-up roof (BUR) or modified roof assembly systems that eliminate or reduce the wrinkles, ridges or tears which, as a result of thermal cycling, tend to form at the joint lines of fixed roof deck panels typically employed in this type of roof system. Environmental changes can cause minimal to dramatic shifts in temperature thus seriously threatening the structural integrity of conventional roof systems by promoting wrinkling, ridging and tearing.

Built-up roof (BUR) systems and modified roof membrane assembly systems are well known in the industry and are used in a variety of applications. Conventional prior art roof system technology for buildings and the like have relied upon rigidly fixing the built-up roof (henceforth referred to as BUR) or modified roof membrane (henceforth referred to as MRM) by means of mechanical attachment or direct adhesion to the underlying roof deck and/or insulation board panels installed on the roof structure. Unfortunately, these prior art methods resulted in the following problems or deficiencies.

The temperature conditions caused within the roof by daily thermal cycling (surface temperatures can range from as low as the lowest environmental temperature to as high as 170° F. under bright sun) or rapid temperature changes concomitant sudden storms, results in dissimilar expansion and contraction of the roof. Clearly such a condition is detrimental to structural stability.

Over varying periods of time for individual roof assemblies, unequal expansion/contraction rates cause ridges and/or tears at joint lines between insulation panels or roof deck panels upon which the BUR or MRM is installed. A contributing factor to such roof conditions, other than shear torsional forces created by thermal cycling, is flow of the BUR or MRM materials in the joint areas in which thermal insulation is lesser than in the center of insulation or roof deck panels. The flow of materials exacerbates the ridging and tearing effect of temperature variations.

Alternatively stated, the roof and/or insulating panels are generally constructed from insulative material because it is desirable that panels resist cold and/or heat transmission through their mass. In the joint line areas where the roof panels abut, internal and external temperatures can intermingle, creating the above described dissimilar expansion and contraction. This causes the expanding molecules of the BUR or MRM to move outwardly from the center of the underlying roof panel, upon which the BUR or MRM is installed, towards the outer edges of each individual underlying panel board. The adjoining panel board sections of the BUR or MRM assembly will also have a similar egress pattern out from the center of each underlying panel board as the BUR or MRM heats up.

In the area where the panel boards adjoin, heat can dissipate through the joint into the interior of the building and thus the joint line area can be cooler. Outward thrust from roof material flow, in addition to cycling, causes wrinkles or ridges in the joint line area.

Moreover, a rapid cooling such as occurs during and subsequent to a torrential downpour during a summer heating cycle, can cool the roof from about 150° F.–170° F. to 80° F. or less in a very short period of time. Such rapid cooling causes immediate shrinkage of the roof membrane, thus causing a reverse stress in the joint line area of the BUR or MRM; again, detrimental to structural integrity.

Alleviating the above discussed drawbacks of prior art roof assemblies is clearly of strong interest to the art.

SUMMARY OF THE INVENTION

The above discussed and other problems and deficiencies of the prior art are overcome or alleviated by the built-up roof (BUR) or modified roof assembly system of the present invention. In accordance with the present invention, a built-up roof (BUR) or modified roof assembly system is provided which comprises an additional layer (relative to prior art assemblies) gypsum panels, preformed concrete panels, poured-in-place concrete or mass-weighted composite panels or composite sheets or panels of which have been loose laid over a roof substrate. The additional layer provides two important advantages to the BUR or MRM assembly: first, the material acts as a temperature change buffer and second, the additional layer, not being rigidly fastened to the substrate, can expand and contract as a unit, more uniformly than individual insulation panels. The layer, therefore, allows the BUR or modified roof assembly to conduct heat to or receive heat from the thermal mass of gypsum, concrete or other, similar mass-weighted material which lies immediately below the BUR or modified roof assembly. The benefit hereof is, of course, to mitigate any speedy changes in overall temperature of the roof assembly. As one of skill in the art will appreciate, reducing the speed of contraction and expansion in a roof assembly will add to that assemblies longevity by alleviating the formation of wrinkles, ridges and tears. With respect to the second advantage of the invention, the additional layer is not fixedly attached to the roof substrate, but preferably individual panels of the layer are adhered or affixed to one another such that the entire layer may move as a monolithic unit independently from the underlying insulated roof substrate when the BUR or modified roof assemblies, positioned thereabove, expand and contract due to changes in temperature. Because of the monolithic movement of the assembly and space provided at the perimeter for expansion, them are essentially no areas in which ridges can form.

The assembly of the invention and application technique greatly reduce the development of wrinkles that occurred at the joint lines of the prior art rigidly fixed roof deck insulation panels. In addition, this weighted roof assembly also aids in wind uplift protection by providing a floating, movable mass for the BUR or modified roof assembly. Wind uplift shock is known to be primarily concentrated at the roof perimeter edge. The assembly of the invention, however, is effective at transferring wind uplift to the interior of the roof. The structure and assembly as a whole is therefore far more sound.

In addition, even if the gypsum concrete or other similar material weighted boards were not strapped, mechanically attached, or adhesively bound at their edge portions during installation, thermal transmission in these panel joint line areas would still produce only minimized ridges because the weighted panels employed in the invention are more stable than the underlying insulation or roof deck construction panels. The more uniform expansion and contraction caused by panels of this type is advantageous to the roofing industry. The aforementioned total assembly therefore mitigates the prior art BUR or MRM problems of the underlying joint line area ridging and tearing or cracking.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
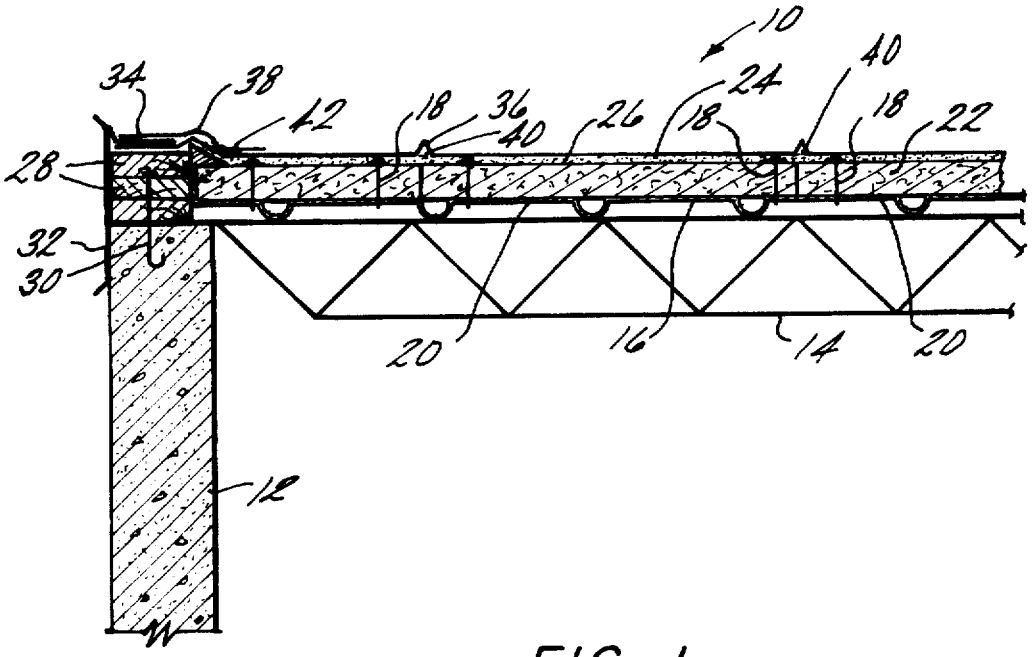
FIG. 1 (PRIOR ART)
FIG. 1 is a cross sectional view of a prior art built-up roof(BUR) or modified roof membrane (MRM) assembly system.
Figure 2:
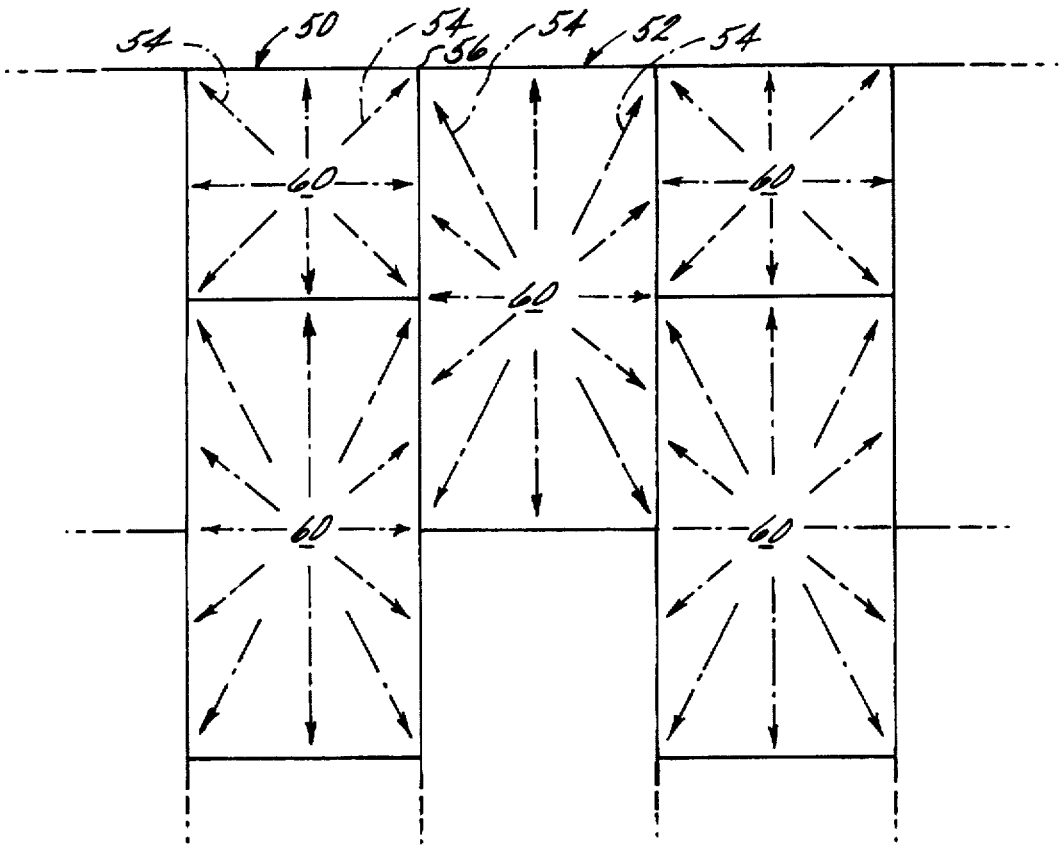
FIG. 2 (PRIOR ART)
FIG. 2 is a partial plan view of a section of prior an built-up roof(BUR) showing the propagation of heat expansion stress from the center of the underlying insulation board to its peripheral edge.
Figure 3:
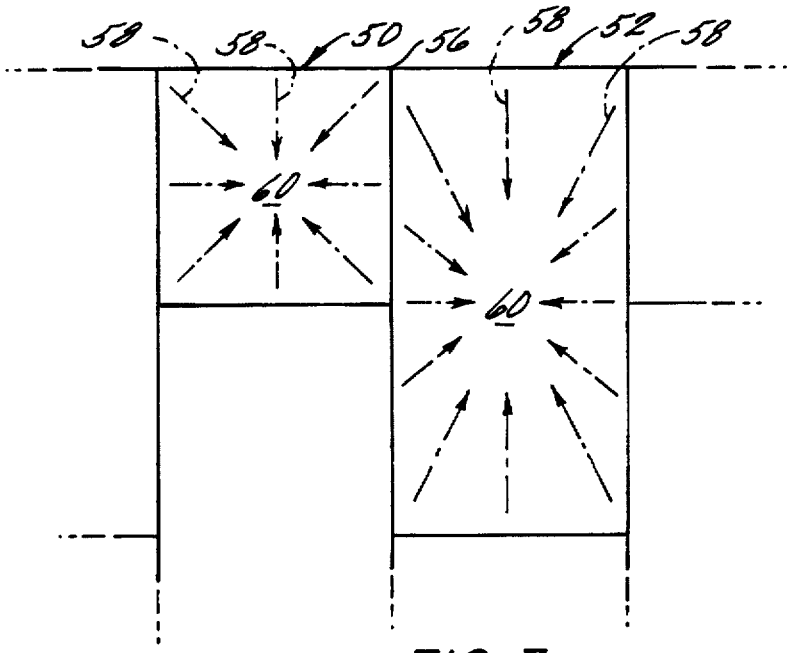
FIG. 3 (PRIOR ART)
FIG. 3 is a partial plan view of the prior art built-up roof(BUR) of FIG. 2 showing the contraction stresses during cooling toward the center of the underlying insulation board inward from its peripheral edge.

Referring first to FIG. 1, the prior art built-up roof (henceforth referred to as BUR) or modified roof membrane (henceforth referred to as MRM) assembly system is generally shown at 10. The structural building wall 12 supports one end of structural roof beam or rafter or joist 14; metal, concrete or the like roof deck panels 16 are fastened to structural roof beam 14 by known means. Common and known BUR insulation layer 22 is installed or fastened rigidly to the roof deck panels 16 by known fasteners 18 or known conventional BUR membrane rigidly installed onto BUR insulation layer 22 by means of asphaltic adhesive (either cold or hot applied) 26. To complete the conventional installation, common wood blocking 28 is used at the perimeter edge of the building, usually anchored to the bearing wall 12 by known fasteners 30 and capped by standard known gravel stop metal edging 32 over which conventional known BUR flashing 34 is installed by known methods. Over a period of time, ridges and stress cracks 36 and 38 develop in the BUR membrane 24 at the insulation layer panel joint line areas 40 and panel joint line area 42 where the insulation panel layer 22 meets the bearing wall 12 of the building. Ridging and cracking 36, 38 of the BUR assembly 24 results from the heating and cooling cycling of the day and night environment to which the BUR assembly 24 is exposed over time. The problems associated with the prior art BUR and MRM roof assembly systems can best be explained with reference to FIG. 2 and FIG. 3 which depict a plan view of a section of prior art roof showing the propagation of heat expansion and contraction stresses in the BUR or MRM assemblies when subjected to daily heating and cooling cycles. FIGS. 2 and 3 show conventional insulation or roof deck panels. In FIG. 2, a typical 4'×4' panel is represented generally at 50 and a typical 4'×8' panel is shown generally at 52 during the course of the heating cycle of a typical day. In FIG. 3, the same two panels 50, 52 are shown during the cooling cycle of a typical afternoon and evening.

In FIG. 2 as the BUR or MRM assembly molecules within thereof expand, the stress lines represented by dashed arrow lines 54 move out from the panel center 60 toward the joint line area 56. In FIG. 3, of course, the contraction stress lines represented by dashed arrow lines 58 move in from the peripheral joint line area 56 toward the center of the panels 60.

There is a different expansion ratio between the BUR of MRM assembly when compared with the relatively stable roof deck or insulation panel to which the BUR or MRM assembly is rigidly attached. Therefore, only the BUR or MRM assembly can absorb the expansion and contraction stresses of the heating and cooling cycles to which the roof is subjected. Because of this phenomena, ridges and tears develop along the joint line areas 56.

Figure 4:
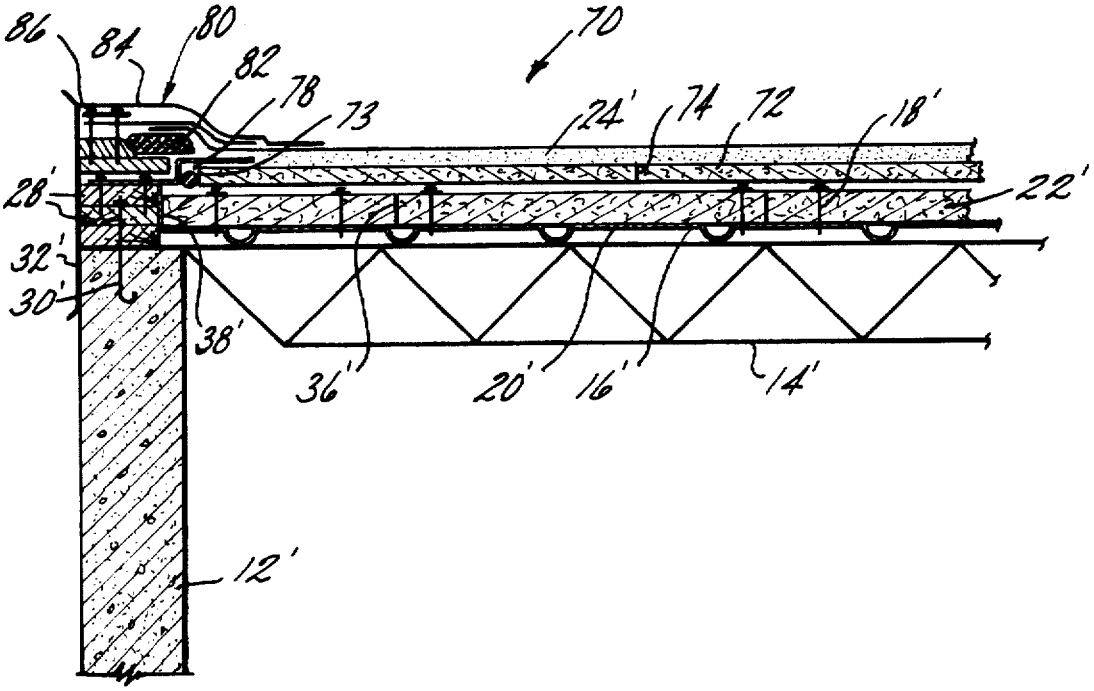
FIG. 4 is a partial cross sectional view of a built up roof assembly system in accordance with the present invention.

The built up roof(BUR) assembly system in accordance with the present invention is shown generally at 70 in FIG. 4 which is a partial cross-sectional view which parallels FIG. 1 (prior art BUR or MRM assembly system). Most of the elements of the BUR or MRM assembly system in accordance with the present invention are similar or the same as the prior art BUR assembly system discussed previously hereinabove and those elements that are the same will carry the same number as in FIG. 1 but will be designated with a prime.

As discussed relative to the prior art roof system, structural building wall 12' supports one end of structural roof beam, rafter or joist 14'. Metal, concrete or the like roof deck panels 16' are fastened to the structured roof beam 14' by known means. Common and known BUR insulation panel layer 22' is installed or fastened rigidly to the roof deck panels 16' by known fasteners 18' or known adhesive layer 20'.

In the prior art BUR assembly system of FIG. 1, a known conventional BUR assembly 24 is rigidly installed onto BUR insulation panel layer 22 by means of asphaltic adhesive 26. In FIG. 4, however, in accordance with the present invention, a loose layer of gypsum, concrete or the like (preferably ½" thick gypsum panels) are placed between the BUR insulation panel layer 22' and the BUR assembly 24'. These weighted board panels 72 provide a thermal heat sink or cold sink for temperature stability. The conventional BUR assembly 24' is bonded directly and rigidly to this weighted board panel layer 72. The joint lines 74 between the weighted board panels 72 are preferably abutted to one another and adhesively or mechanically bonded during installation to make the weighted board panels act as an integral floating mass. Another method is to forcefully spread apart the weighted board panels 72 during installation providing a minimum ⅛" gap between the weighted board panels 72 and then fill this gap with adhesive or other known compound in order to tie the weighted board panels 72 together. Tying together of the weighted board panels 72 results in a floating modulus with uniform expansion and contraction forces which tend to keep the BUR assembly 24', which is installed rigidly to the underlying weighted board panel layer 72, from wrinkling, ridging or tearing at either the weighted board joint lines 76 or the underlying BUR insulation panel layer 22' joint lines 36' and 38'.

To complete the installation of the BUR assembly system in accordance with the present invention, common wood blocking 28' is used at the perimeter edge of the building, usually anchored to the bearing wall 12' by known fasteners 30' capped by standard known gravel stop metal edging 32'. Unlike the prior art BUR assembly system, however, an expansion and contraction channel 78 is provided. Channel 78 is provided to allow expansion of the weighted board panel layer 72 edges 73 at the outer roof perimeter and any penetrations of the BUR roof assembly system.

Over channel 78 is a special expandable flashing member 80 that is capable of absorbing the expansion and contraction of the BUR assembly 24'. Flashing member 80 comprises a soft foam core layer 82 preferably comprising dense foam rubber such as neoprent backer. Flashing outer layer 84 is then attached over the soft foam core layer 82 such that said outer layer 84 may "float" over layer 82. A special polymeric adhesive 86 (such as sonnolestic) which is capable of accommodating the diverse expansion and contraction of the metal gravel stop edging 32' along the roof perimeter edge. Soft foam core layer 82 is commercially available from building supply houses.

Figure 5A:
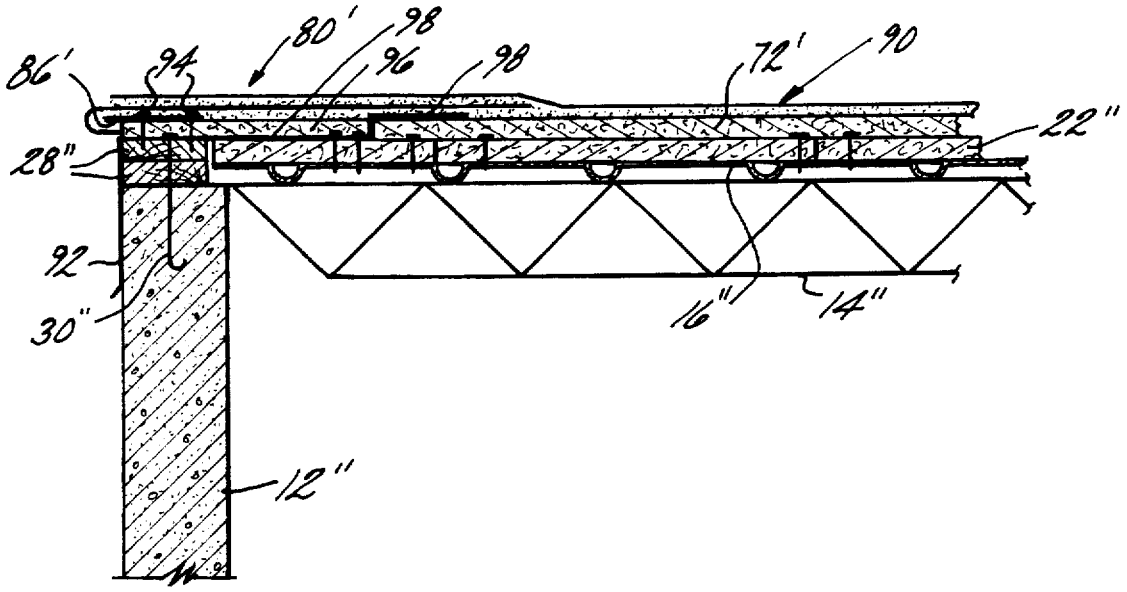
FIG. 5A is a partial cross sectional view (similar to FIG. 4) of a modified roof membrane (MRM) assembly system in accordance with the present invention.

The modified roof assembly system (MRM) depicted in FIG. 5A is quite similar to the BUR assembly system previously discussed in relation to FIG. 4 except that substituted for the conventionally known BUR assembly 24' shown in FIG. 4, a known modified roof membrane assembly (hereinafter referred to MRM) 90 is employed. Since there is no need for the gravel stop metal edging 32' of FIG. 4, it is replaced with a metal casing edge 92 (or other suitable material) and is made integral with the special expandable flashing member 80 which is capable of absorbing the expansion and contraction that occurs within the MRM assembly 90.

As was previously discussed with reference to FIG. 4, the MRM assembly 90 is attached rigidly by known methods to a loose layer of gypsum weighted board panels or the like 72' which are preferably tied together so as to act as an integral floating mass to accommodate expansion and contraction of the MRM assembly 90 affixed to the board panel layer 72'. However, a narrow portion of weighted gypsum board 96 along the perimeter of the roof or any penetration of the MRM assembly 90 is fixedly fastened by known fasteners 94 which anchor narrow weighted gypsum board 96 to common wood blocking 28" used at the perimeter edge of the building. Of course, the common wood blocking 28" is in turn anchored to bearing wall 12" by known anchor fasteners 30". Of course, the underlying elements of structural roof beam 14", roof deck panels 16" and insulation panel layer 22" are all made of known materials and assembled by known methods and fastened in the same manner as depicted and described in FIG. 4.

MRM assembly 90 is sealed between weighted gypsum board panel layer 72" and rigidly fixed to anchor weighted gypsum board narrow portion 96 by the use of special sealing compound layer 98. Flashing member 80' is fixedly anchored to the outside peripheral edge or rigidly fixed anchor weighted gypsum board 96. Board 96 is endowed with a special polymeric adhesive compound 86' (such as caulk) which is capable of accommodating the diverse expansion and contraction of the metal coping edge 92. The special expandable flashing member 80' in this manner absorbs the expansion and contraction that occurs within the MRM assembly 90 at the perimeter of the roof and at the various penetrations of the modified roof membrane assembly system in accordance with the present invention.

Figure 5B:
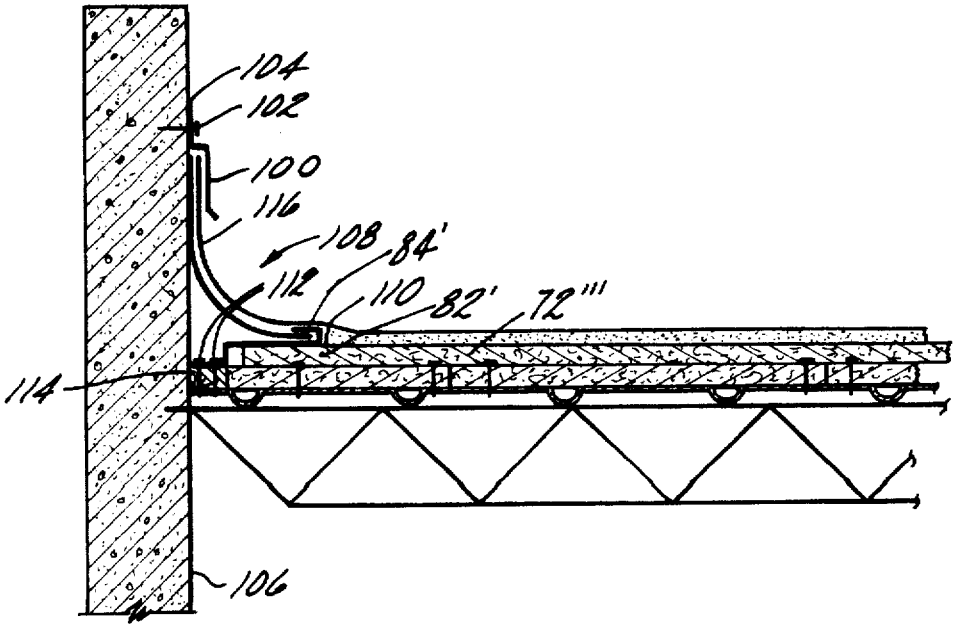
FIG. 5B is a partial cross sectional view of the built up roof (BUR) assembly system of FIG. 4 modified with a special movable spring wall flashing detail to meet a parapet wall in accordance with the present invention.

A special movable spring flashing detail to accommodate expansion and contraction of either a BUR assembly or MRM assembly is depicted in FIG. 5B in accordance with the present invention. The rest of the roof is constructed similarly to that illustrated in FIGS. 4 and 5A except where the roof approaches the parapet or the type of wall.

Metal rain shield anchor strip 100 is fastened by known fasteners 102 to an appropriate distance up the parapet or other wall. Sealing compound 104 produces a weather tight seal between metal rain shield anchor strip 100 and the parapet or other wall 106. The entire special movable spring flashing assembly is generally shown at 108.

At the other end of special movable spring flashing assembly 108 is a metal flashing retainer and anchor strip 110 which is fastened by known fasteners 112 to a known nailer 114. Of course, both rain shield anchor strip 100 and flashing retainer and anchor 110 is a soft core layer 82' over which the flashing outer layer 84' may float so as to accommodate the diverse expansion and contraction that has been developed in the rest of the BUR or MRM assemblies. Such movements are thus dissipated into the movable portion 116 of the special movable spring flashing assembly 108 without causing permanent wrinkles or tears in the rest of the BUR or MRM assemblies.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A roof assembly comprising:

a) a roof substrate;

b) a layer of loose laid mass-weighted material resting on and unsecured to said roof substrate to allow relative movement between said material and said substrate; and c) a roof waterproofing construction upwardly adjacent and at least partially affixed to said layer of mass-weighted material.

2. A roof assembly as claimed in claim 1 wherein said mass-weighted material is selected from the group consisting of gypsum board panels, preformed concrete panels, poured-in-place concrete and composite mass-weighted construction panels.

3. A roof assembly as claimed in claim 1 wherein said mass-weighted material comprises a plurality of individual panels.

4. A roof assembly as claimed in claim 3 wherein said panels are gapped at least about ⅛ inch apart said gap being subsequently filled with sealant.

5. A roof assembly as claimed in claim 4 wherein said gap is insured by at least one spacer clip.

6. A roof assembly as claimed in claim 3 wherein said panels are connected together.

7. A roof assembly as claimed in claim 3 wherein said panels are connected by an adhesive material.

8. A roof assembly as claimed in claim 7 wherein said adhesive material is asphaltic material.

9. A roof assembly as claimed in claim 7 wherein said adhesive material is urethane material.

10. A roof assembly as claimed in claim 7 wherein said assembly further includes a protective sheet structure interposed between the mass-weighted layer and the substrate to prevent the adhesive from bonding to the substrate.

11. A roof assembly as claimed in claim 3 wherein said panels are connected mechanically.

12. A roof assembly as claimed in claim 11 wherein said mechanically connected panels are connected by screws.

13. A roof assembly as claimed in claim 11 wherein said mechanically connected panels are connected by straps.

14. A roof assembly as claimed in claim 11 wherein said mechanically connected panels are connected by staples.

15. A roof assembly as claimed in claim 11 wherein said mechanically connected panels are connected by clips.

16. A roof assembly as claimed in claim 11 wherein said mechanically connected panels are connected by splice plates.

17. A roof assembly as claimed in claim 11 wherein said mechanically connected panels are connected by tape.

18. A roof assembly as claimed in claim 11 wherein said mechanically connected panels are connected by edge stripping.

19. A roof assembly as claimed in claim 3 wherein said plurality of individual panels each having a top and a bottom surface and perimetrical edges, are connected edge wise to adjacent panels on both the top and bottom surface of each panel proximate to the edges of each panel.

20. A roof assembly as claimed in claim 1 wherein said roof waterproofing construction is a BUR.

21. A roof assembly as claimed in claim 20 wherein said BUR comprises material selected from the group consisting of coal tar-based material, pitch-based material and asphaltic material.

22. A roof assembly as claimed in claim 1 wherein said roof waterproofing construction is a single ply membrane.

23. A roof assembly as claimed in claim 1 wherein said roof waterproofing construction is a modified roof membrane.

24. A roof assembly as claimed in claim 1 wherein said substrate is air sealed.

25. A roof assembly as claimed in claim 1 wherein said mass-weighted layer is perimetrically dimensioned to define, with roofing material, a channel into which the mass-weighted layer may expand.

26. A roof assembly as claimed in claim 25 wherein said channel further includes a resilient member to absorb expansion and aid in push back of the mass-weighted layer during contraction.

27. A roof assembly as claimed in claim 26 wherein said resilient member is metal.

28. A roof assembly as claimed in claim 26 wherein said resilient member is plastic.

29. A roof assembly as claimed in claim 25 wherein said mass-weighted layer is further dimensioned to provide said channel adjacent any structure of said roof substrate penetrating or protruding through said roof assembly.

30. A roof assembly as claimed in claim 25 wherein said channel is overlaid by a soft core foam material having properties enabling a large expansion and contraction without rupturing.

31. A roof assembly as claimed in claim 30 wherein said soft core foam is environmentally protected by a flashing secured thereover.

32. A roof assembly as claimed in claim 1 wherein said substrate is air permeable.

33. A roof assembly as claimed in claim 1 wherein said assembly includes an air barrier film positioned in one of over the mass-weighted layer, under the mass-weighted layer and over the roof substrate.

34. A roof assembly as claimed in claim 1 wherein said mass weighted layer includes at least one surface, said surface including separator channels to vent heat and moisture.

35. A roof assembly comprising:

a) a roof substrate;

b) a layer of insulative material affixed to said roof substrate;

c) a layer of mass-weighted material loose laid over, resting on and unsecured to said insulative material to allow relative movement between said mass-weighted material and said insulative material;

d) a waterproofing construction at least partially affixed to said mass-weighted material.

36. A roof assembly as claimed in claim 35 wherein said assembly further includes a channel adjacent a perimetrical edge of said mass-weighted material.

37. A roof assembly as claimed in claim 36 wherein said channel is further provided adjacent any structures of said roof substrate which penetrate through said roof assembly.

38. A roof assembly as claimed in claim 35 wherein said assembly further includes grooves cut into at least one of a top surface of said insulative material, a bottom surface of said insulative material, a top surface of said mass-weighted material and a bottom surface of said mass-weighted material for receiving a sealant material.

39. A roof assembly as claimed in claim 38 wherein said sealant material is gummy rope.

* * * * *